United States Patent [19]

Tetu

[11] 4,222,387

[45] Sep. 16, 1980

[54] PROSTHESIS BRASSIERE

[76] Inventor: Thérèse Têtu, 3 Westmount Sq., Apt. 1114, Montreal, Quebec, Canada, H3Z 2P0

[21] Appl. No.: 934,066

[22] Filed: Aug. 16, 1978

[30] Foreign Application Priority Data

Aug. 26, 1977 [CA] Canada ..... 285608

[51] Int. Cl.[2] ..... A41C 3/00

[52] U.S. Cl. ..... 128/460

[58] Field of Search ..... 128/460, 479, 480, 510; 2/104

[56] References Cited

U.S. PATENT DOCUMENTS

| | | | |
|---|---|---|---|
| 1,884,243 | 10/1932 | Richards | 128/460 |
| 2,258,209 | 10/1941 | DeJorio | 2/104 |
| 2,407,220 | 9/1946 | Blocker | 128/460 |
| 2,953,133 | 9/1960 | Seller | 128/479 |
| 3,348,241 | 10/1967 | Dodds | 128/478 |
| 3,401,407 | 9/1968 | Pittman | 3/36 |
| 3,425,420 | 2/1969 | Steinberger | 128/460 |
| 3,513,852 | 5/1970 | Seidl | 128/460 |
| 3,561,442 | 2/1971 | Goswitz | 128/482 |
| 3,710,800 | 10/1971 | Carey | 128/488 |
| 3,896,506 | 7/1975 | Hankin et al. | 3/36 |

FOREIGN PATENT DOCUMENTS

| | | | |
|---|---|---|---|
| 725337 | 1/1966 | Canada . | |
| 907252 | 8/1972 | Canada . | |
| 919893 | 12/1946 | France | 128/460 |

*Primary Examiner*—Werner H. Schroeder
*Assistant Examiner*—Doris L. Troutman
*Attorney, Agent, or Firm*—Raymond A. Robic; Arthur Schwartz

[57] ABSTRACT

This invention relates to a prosthesis brassiere for use by a woman who has gone through a mastectomy. The brassiere, which comprises one cup provided with a conventional filler and a second cup shaped for receiving and supporting the remaining breast, is characterized in that the cup for the remaining breast is provided along its entire periphery with detachable securing means comprising, for example, a zipper or a set of snap fasteners. The securing means makes it possible to easily and completely detach and remove the cup receiving and supporting the remaining breast from its peripheral carrying strap, and to reattach it to the same, while leaving the cup with the filler in place. Thus, the user can strip or cover the remaining breast, at will.

13 Claims, 4 Drawing Figures

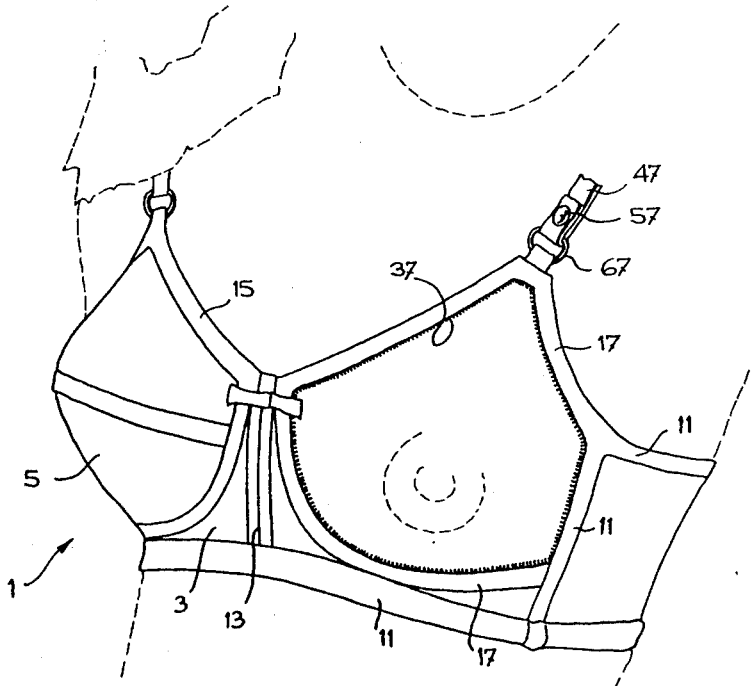
FIG. 3
FIG. 4
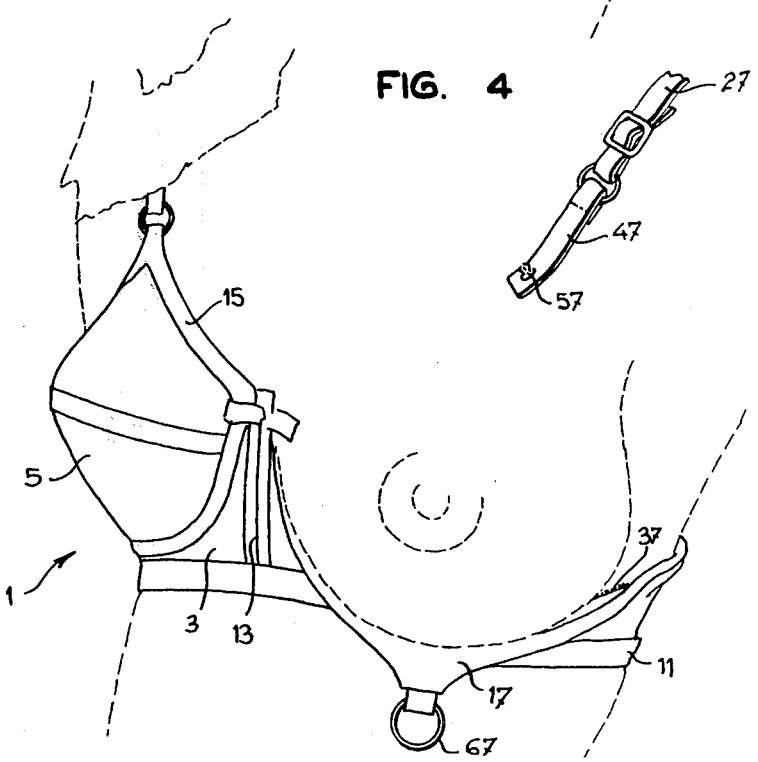

PROSTHESIS BRASSIERE

TECHNICAL FIELD OF THE INVENTION

The present invention relates generally to a prosthesis brassiere especially intended for use by a woman who has gone through a mastectomy. More particularly, it relates to such a brassiere wherein the cup covering the woman's remaining breast can be easily and completely removed, and reinstalled, whereby the breast can be covered or exposed at will.

BACKGROUND OF THE PRIOR ART

Numerous models of prosthesis brassieres for use by women who have undergone the ablation of one breast are known, and are commonly available. These known brassieres all have one cup completely filled with soft plastic foam, or with another suitable filler such as a liquid-containing bag, for filling up the "gap" left by the surgical operation, and another cup having a conventional shape, for receiving and supporting the remaining breast. But, even if such brassieres effectively give a natural and completely feminine appears to the women who use them, unfortunately, they do not help these women to solve the psychological problems often generated not only by the absence of one breast, but also by the presence of a postoperational scar that may have substantial dimensions and minimal aesthetic aspects.

These psychological problems are important, especially because they often have an effect upon the spirit of the patient, and because they can dramatically affect her relations with her partner and, more particularly, her married life. Indeed, the patient can be, for various justifiable reasons peculiar to every person having undergone any ablation, deeply embarrassed and even sometimes humiliated to show her scar, even in the most natural situations for a married couple.

To obviate these problems, some accessories are commonly available, in the shape of a breast, provided with fixing straps or elastic bands, for hiding the absence of one breast as well as the presence of the scar, when needed. However, that kind of accessory is not very convenient, not very feminine and, because of its system of fixation, is often subject to shifting in use.

There is thus a need for an improved prosthesis brassiere, one that better meets the psychological needs of a woman who has undergone a mastectomy, and which will allow her to live a more normal and fulfilling life. The present invention is intended to meet that need.

SUMMARY OF THE INVENTION

The prosthesis brassiere of the invention includes one cup provided with a filler, and another cup for receiving and supporting the remaining breast, both mounted on peripheral carrying straps. The cup receiving and supporting the remaining breast is provided along its entire periphery with detachable securing means, which, for example, can comprise a zipper or a set of snap fasteners. This securing means makes it possible to easily and quickly detach and remove the cup receiving and supporting the remaining breast from its peripheral strap, and to reattach it to the same, while leaving the cup with the filler in place. Thus, the woman can strip or cover the remaining breast, at will.

The prosthesis brassiere according to the invention, as is usual, includes two shoulder straps respectively fixed to the upper extremities of the peripheral straps holding the cups. In a preferred embodiment of the invention, the shoulder strap which is fixed to the upper extremity of the peripheral strap of the detachable cup is provided with attaching means, arranged to permit the shoulder strap to be easily and completely detached from the peripheral strap, and reattached to the same, at will. In another preferred embodiment of the invention, the prosthesis brassiere of the invention can be fitted to or formed as an integral part of a slip or a nightgown.

It is the principle object of the present invention to provide a prosthesis brassiere which overcomes the noted drawbacks encountered with known prosthesis brassieres, and breast-shaped accessories.

Another object is to provide a prosthesis brassiere for women who have gone through a mastectomy, which permits the user to completely strip her remaining breast while keeping up a full feminine appearance and hiding the scar left by the operation.

A further object is to provide a prosthesis brassiere for women who have gone through a mastectomy, designed to give psychological support to a woman and to enable her to live a more normal life.

Other objects and many of the attendant advantages of the invention will become readily apparent from the following description of the preferred embodiments, taken in conjunction with the accompanying drawings.

BRIEF DESCRIPTION OF THE DRAWINGS

The following preferred embodiments of the invention are described with the aid of the attached drawings.

FIG. 3 is a view similar to FIG. 1, but showing the brassiere of FIG. 1 with the removable cup completely detached; and FIG. 4 is a perspective view again showing the brassiere of FIG. 1, but with the shoulder strap detached from the peripheral strap holding the removable cup, and such peripheral strap and the removable cup moved downwardly over the remaining breast.

DESCRIPTION OF THE PREFERRED EMBODIMENTS

Figure 1:
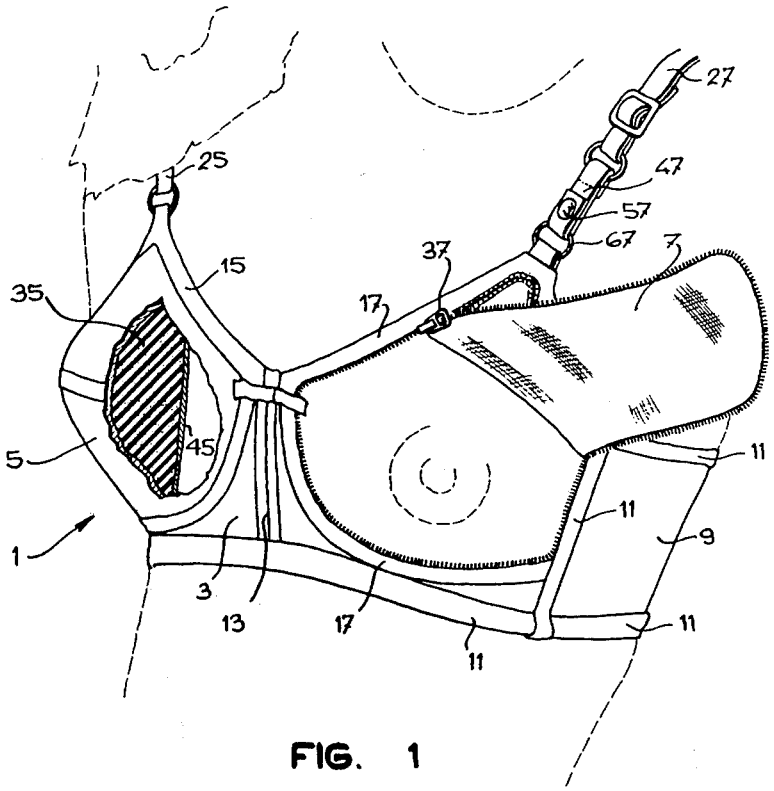
FIG. 1 is a front, perspective view of a first embodiment of the prosthesis brassiere of the invention, with the cup covering the woman's remaining breast shown in a partially attached position, and the other cup shown partially broken away.

The prosthesis brassiere 1 shown in FIGS. 1, 3 and 4 of the drawings includes, like every brassiere, a front panel 3 provided with two cups 5 and 7, and a rear panel 9 generally made of two pieces which may be attached in the middle of the back of the user by means of conventional fixing means, not shown. The front panel 3 and the rear panel 9 are both edged with one or several seams or holding straps 11 extending horizontally and vertically, and can be provided with several reinforcing straps 13, which may enclose reinforcement strips of plastic, metal or the like, if so desired.

The cups 5 and 7 are respectively fixed along their entire periphery to two peripheral rings of straps 15 and 17 which form, together with their corresponding holding straps 11 to which they are connected a complete curve following the contour of the breast of the user.

The prosthesis brassiere 1 also includes two adjustable shoulder straps 25 and 27, respectively, fixed at one end thereon, to the upper extremities of the peripheral straps 15 and 17 of the cups 5 and 7, and at their other ends to the rear panel 9.

The prosthesis brassiere 1, like every brassiere intended for use by a woman having undergone the ablation of one breast, has a cup 5 provided with a filler 35 used for filling up the gap left by the surgical operation, and another cup 7 having a conventional shape, for receiving and supporting the remaining breast.

In the drawings, the cup 5 provided with a filler has been shown in a position where it replaces the right breast of the woman. But, it is obvious that this cup 5 provided with a filler can be used for replacing either the right breast or the left breast, as the case may be.

The filler 35 of the cup 5 can comprise a pad made of soft plastic foam, or a bag which can receive a predetermined amount of liquid, shaped so as to perfectly imitate the shape, design and/or the weight of the missing breast.

The filler 35 of the cup 5 is generally mounted so that it can be easily removed and washed. It is also generally provided with a flat rear surface 45 made of cotton or another suitable soft fabric to avoid irritation of sensitive spots on the body of the user, such as the scar left by the operation.

Of course, this cup 5 is shaped so as to be of the same dimension and shape as the cup 7 receiving the remaining breast. The dimensions and shape of the cups 5 and 7 as well as the respective position of the same with respect to the bust of the user are variable, as can be easily understood, and depend only on the physical aspect of the woman by whom the brassiere is intended for use.

The essential inventive characteristic of the prosthesis brassiere shown in FIGS. 1, 3 and 4 lies in that the cup 7, supporting and covering the remaining breast, is detachable or removable.

To this end, the cup 7 is provided along its entire periphery with securing means 37, which makes it possible to secure it to or to detach it from its peripheral strap 17 at will. The securing means 37 of FIGS. 1, 3 and 4 consists of a zipper 37, preferably a zipper made of plastic material, for the purpose of comfort and washing.

Figure 2:
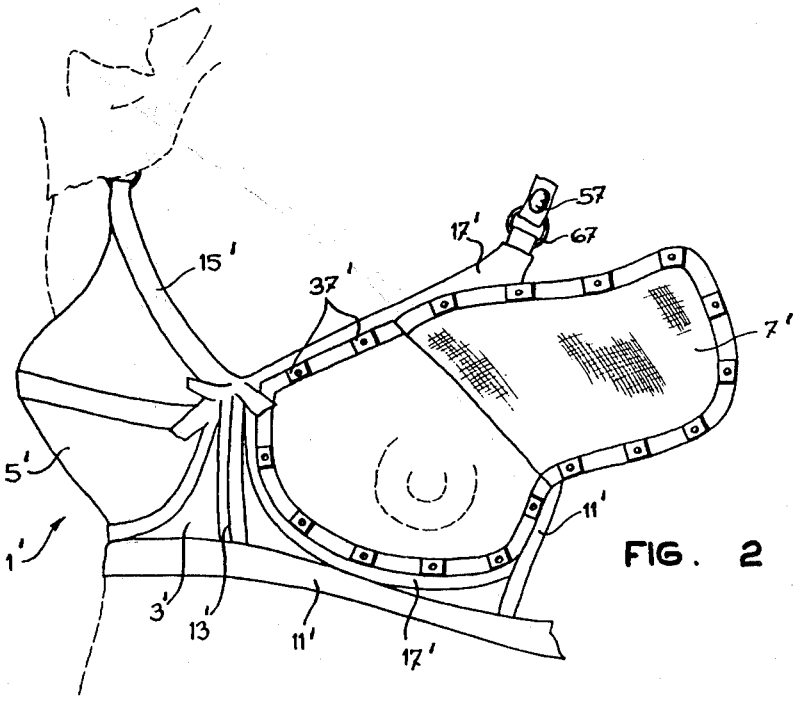
FIG. 2 is a front perspective view similar to FIG. 1, but showing a second embodiment of the invention, wherein snap fasteners are utilized to detachably secure the removable cup.

Referring now to the brassiere 1' of FIG. 2, such includes cups 5' and 7', carried by peripheral straps 15' and 17', and straps 11' and 13' on a front panel 3'. In this embodiment, the removable cup 7' is secured by a set of spaced snap fasteners 37', instead of a zipper. Except for the use of a different securing means, the brassiere 1 and 1' are identical, and it is to be understood that other detachable securing means might also be used.

Whatever the selected securing means for the removable cup, use is preferably made of strips of fabric, lace or scallops (not shown) for covering and hiding the securing means to thus give the brassiere a more pleasant and greater aesthetic aspect.

The described prosthesis brassieres 1 and 1' not only give a feminine and natural appearance to the woman who uses them in the conventional way, but also allow the user to completely uncover her remaining breast in some marital situations, while keeping her full feminine appearance and perfectly hiding the scar left by the mastectomy without risk of inadvertent exhibition. The psychological advantages attached to this should be readily apparent.

The prosthesis brassiere of the invention also permits a woman who has gone through a mastectomy and who, later on, becomes a mother, to suckle her child, while always keeping her full feminine appearance.

In order to better strip the remaining breast, the prosthesis brassieres 1 and 1' are provided with attaching means 47, arranged to allow the shoulder strap 27 to be completely detached from the upper extremity of the peripheral strap 17 or 17' of the cup 7 or 7' so as to more completely uncover and "liberate" the remaining breast, as shown in FIG. 4 for the brassiere 1 of FIG. 1.

Preferably, the shape of the peripheral straps 17 and 17' are chosen so that their upper extremities follow the curve of the lower part of the breast when the strap is detached, as shown in FIG. 4 for the brassiere 1.

The attaching means 47 can consist of a strap or a flat buckle, a set of clips, or any other equivalent means such as commonly used in hosiery. In the embodiments shown in the drawings, the upper extremities of the peripheral straps 17 and 17' are provided with rings 67, and the shoulder straps 27 each include an end portion which is insertable through its associated ring 67 and which is detachably secured by a snap fastener 57.

It should be understood that the particular design, the decoration and the shape of the prosthesis brassiere of the invention are left to the manufacturer's desires, and the wishes of the consumer. In fact, several models of different shapes can be created, unadorned as in the drawings, or provided with scallops, laces or any other decorative accessories or ornaments.

The prosthesis brassiere of the invention can also be used in combination with a nightgown or any similar feminine underwear. For example, in a nightgown the bust thereof can comprise a cup provided with a filler, and another cup mounted and arranged to be removable, as described and shown herein in connection with the brassieres 1 and 1'. This same construction can also be incorporated into a baby doll gown, into a slip, or other lingerie.

Obviously, many modifications and variations of the invention are possible.

What is claimed is:

1. A prosthesis brassiere for women who have gone through a mastectomy of the type comprising one cup provided with a filler permanently attached, and another cup for receiving and supporting the remaining breast, each mounted on a peripheral strap, the improvement comprising in that the cup receiving and supporting the remaining breast is provided along its entire periphery with securing means detachably connecting it with its associated peripheral strap, constructed and arranged to allow said other cup to be easily and quickly detached and removed from its peripheral strap, and to be reattached, all while leaving the cup with the filler permanently in place.

2. A prosthesis brassiere as claimed in claim 1, including additionally two shoulder straps respectively connected to the upper extremities of the peripheral straps of the cups, the improvement comprising in that the shoulder strap which is connected to the upper extremity of the peripheral strap of the removable cup is provided with detachable connecting means located near the peripheral strap, constructed and arranged to enable said shoulder strap to be easily and completely detached from said peripheral strap, and to be reattached thereto.

3. A prosthesis brassiere as claimed in claim 2, wherein the connecting means located near the peripheral strap of the removable cup is a snap fastener.

4. A prosthesis brassiere as claimed in claim 1 or 2, wherein the detachable securing means is a zipper.

5. A prosthesis brassiere as claimed in claim 1 or 2, wherein the detachable securing means is a set of snap fasteners.

6. A prosthesis brassiere as claimed in claim 1 or 2, wherein said detachable securing means is covered along its entire length with concealing means, to at least partially conceal its presence.

7. A prosthesis brassiere as claimed in claim 1 or 2, wherein said brassiere is incorporated into a gown-like garment.

8. A prosthesis brassiere for women who have gone through a mastectomy, including:

a front panel;

a rear panel connected with said front panel;

two pair of peripheral straps carried by said front panel;

a first cup permanently secured to one of said peripheral straps and provided with a filler;

a second cup for receiving and supporting the woman's remaining breast; and securing means along the entire periphery of said second cup, for detachably securing said second cup to said second peripheral strap, constructed and arranged to allow said second cup to be easily and quickly detached and removed, and to be reattached, all while leaving said first cup with the filler permanently in place.

9. A prosthesis brassiere as claimed in claim 8, including additionally:

a pair of shoulder straps, each connected at one end to said rear panel;

first means for connecting the other end of a first one of said shoulder straps with the upper extremity of said first one of said peripheral straps; and second means for detachably connecting the other end of said other shoulder strap with the upper extremity of said second of said peripheral straps, constructed and arranged to enable said other shoulder strap to be easily and completely detached from said peripheral strap, and to be reattached thereto.

10. A prosthesis brassiere as claimed in claim 9, wherein said means for detachably connecting the other end of said other shoulder strap comprises a snap fastener, carried by said other shoulder strap, and ring means carried by said second peripheral strap, through which said other end of said other shoulder strap is receivable.

11. A prosthesis brassiere as claimed in claims 9 or 10, wherein said securing means is a zipper.

12. A prosthesis brassiere as claimed in claims 9 or 10, wherein said securing means is a set of snap fasteners.

13. A prosthesis brassiere as claimed in claim 9 or 10, including additionally concealing means along the entire length of said securing means, for at least partially concealing such.

* * * * *